US006354035B1

(12) United States Patent
Niebuhr et al.

(10) Patent No.: US 6,354,035 B1
(45) Date of Patent: Mar. 12, 2002

(54) BRASS CATCHER

(76) Inventors: Robert Edward Niebuhr; Richard John Niebuhr, both of 1751 Thunderhill Dr., Pheonix, AZ (US) 85045

( * ) Notice: Subject to any disclaimer, the term of this patent is extended or adjusted under 35 U.S.C. 154(b) by 0 days.

(21) Appl. No.: 09/566,039

(22) Filed: May 6, 2000

(51) Int. Cl.[7] ..... F41C 27/00; F41A 9/60
(52) U.S. Cl. ..... 42/98; 42/98; 89/33.4
(58) Field of Search ..... 42/98; 89/33.4

(56) References Cited

U.S. PATENT DOCUMENTS

| | | | | | |
|---|---|---|---|---|---|
| 663,262 | A | * | 12/1900 | Dieterich | 42/98 |
| 3,009,565 | A | * | 11/1961 | Leone | |
| 3,031,069 | A | * | 4/1962 | Hirsch | |
| 3,153,981 | A | | 10/1964 | Brass | 89/33 |
| 3,658,241 | A | | 4/1972 | Pistocchi | 232/1 R |
| 3,744,623 | A | * | 7/1973 | Woofter | |
| 4,110,927 | A | * | 9/1978 | Morris | |
| 4,296,565 | A | | 10/1981 | Jaffin et al. | 42/1 T |
| 4,715,141 | A | * | 12/1987 | Kohnke | 42/98 |
| 4,959,918 | A | | 10/1990 | Perez | 42/98 |
| 5,398,439 | A | * | 3/1995 | Harless | 42/98 |
| D382,624 | S | | 8/1997 | Benson | D22/108 |
| 5,664,727 | A | * | 9/1997 | Beall | |
| 6,173,520 | B1 | * | 1/2001 | Bucciarelli et al. | 42/98 |

FOREIGN PATENT DOCUMENTS

| | | | | |
|---|---|---|---|---|
| CH | 679519 A5 | * | 2/1992 | 42/98 |
| CH | 679607 A | * | 3/1992 | 89/33.4 |
| EP | 0 344 520 A1 | | 5/1989 | |

* cited by examiner

*Primary Examiner*—Peter M. Poon
*Assistant Examiner*—Lulit Semunegus

(57) ABSTRACT

An apparatus comprising a portable, standing screen with a bin that can be placed near the person firing a semi-automatic weapon. The screen has a base section and an upright frame section. The upright frame section can be removed from the base to facilitate transportation or storage. The upright section has an angled top, a back and a bin. The angled top is directed toward the user at an approximate fifty (50) degree angle. The back fits stands vertically when fitted into the base. Extending from the back is a bin with a right side and left side directed toward the user. The top, back and bin are covered with screening to prevent any brass from passing through.

19 Claims, 3 Drawing Sheets

BRASS CATCHER

BACKGROUND OF THE INVENTION

1. Field of the Invention

The present invention relates to an apparatus for collecting or retrieving spent cartridges which are automatically ejected from firearms and, more particularly, to catching empty cartridges as they are ejected from a firearm which is fired repeatedly from a relatively fixed position such as in target shooting.

2. Description of the Prior Art

A large number of firearms enthusiasts reload their ammunition themselves. Others desire to collect the spent cartridges so that they may have the cartridges reloaded by someone else. After the firearm is fired, the spent cartridge is ejected and thrown from the firearm. The spent cartridge normally lands on the ground, if the range is outdoors, or on a concrete floor, if the range is indoors. While the cartridges can be retrieved, they may have acquired dirt, they may have been bent by the fall or they may have been bent by someone stepping on them. The retrieval of the brass is time consuming, and thinking about the location of the spent cartridge can be distracting to the shooter. In some cases, spent cartridges can strike another shooter, causing a distraction. Therefore, a need exists for a efficient, inexpensive way to catch the cartridges as they are ejected from the firearm.

U.S. Pat. No. 4,296,565 discloses a free standing receptacle having a vertical opening placed next to the firearm and a resilient material attached to the opening for catching the cartridges in a bag-like structure. U.S. Pat. No. 3,658,241 discloses a free standing box like structure with a hatch that serves to deflect spent cartridges into the box where they can be extracted through a trap door. U.S. Pat. No. 4,959,918 and U.S. Pat. No. 3,153,981 disclose devices that can be attached to a firearm for catching the spent cartridges.

A need exists beyond the prior art for a device to catch spent cartridges without adding weight to the firearm by attaching the device to the firearm. Therefore, a free standing device is preferred. Existing free standing devices require the user to hold the firearm very close to the aperture or opening of the catching device which restricts the users movement and causes distraction. Therefore, a need exists for a free standing device that does not require the user to hold the weapon in very close proximity to the catching device.

SUMMARY OF THE INVENTION

The present invention meets the needs and solves the problems identified above by providing an apparatus comprising a portable standing screen with a bin that can be placed near the person firing a semi-automatic weapon. The screen has a base section and an upright frame section. The upright frame section can be removed from the base to facilitate transportation or storage. The upright section has an angled top, a back and a bin. The angled top is directed toward the user at an approximate fifty (50) degree angle. The back stands vertically when fitted into the base. Extending from the back is a bin with a front, a right side and a left side extending toward the user. The top, back and bin are covered with screening to prevent any brass from passing through.

The foregoing and other objects, features and advantages of the invention will be apparent from the following more particular description of a preferred embodiment of the invention, as illustrated in the accompanying drawings wherein like reference numbers represent like parts of the invention.

DESCRIPTION OF PREFERRED EMBODIMENTS

Figure 1:
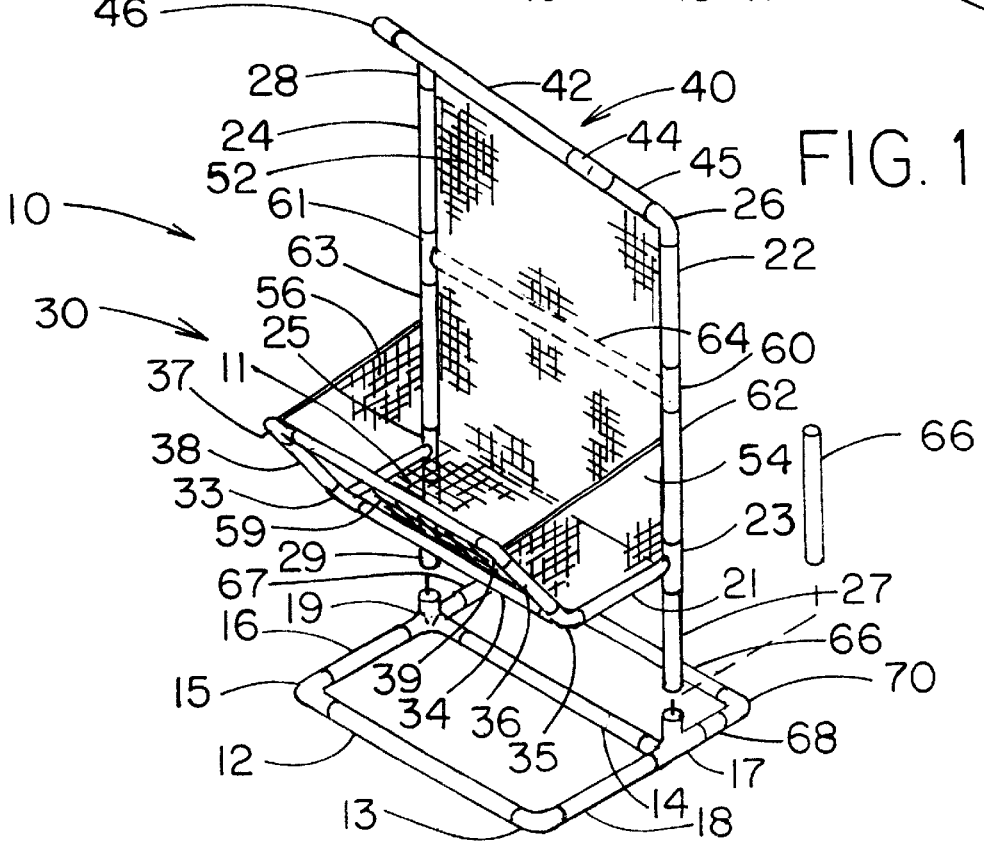
FIG. 1 is a right front perspective view of the invention.

In FIG. 1, Catcher 100 has top 40, back 20, bin 30 and base 10. Back 20 has back right joint 23 and back left joint 25 for supporting bin 30. Back first left support 63 has a first end which fixedly engages the upper opening of back left joint 25. Back first right support 62 has a first end which fixedly engages the upper opening of back right joint 23. Back first right support 62 has a second end which is fixedly engaged to back second right support 22 and back middle support 64 by back right three-way connector 60. Back first left support 63 has a first end which fixedly engages back left joint 25. Back first left support 63 is fixedly engaged to back second left support 24 and back middle support 64 by back left three-way connector 61. Back right elbow 26 is fixedly engaged to the top of back second right support 22. Back left elbow 28 is fixedly engaged to the top of back first left support 24. Back right connector 27 may be fixedly engaged to the bottom of back right joint 23 or alternatively, back right connector 27 may be removably engaged to the bottom of back right joint 23 so that back right extension 66 may be substituted. Back left connector 29 is fixedly engaged to the bottom of back left joint 25. In the preferred embodiment, back 20 is approximately thirty (30) inches wide by forty three (43) in height. Optional back right extension 66 and back left extension (not shown) may be substituted for back right connector 27 and back left connector 29 in order to raise the height of bin 30 when base 10 is positioned at ground level. Option back right extension 66 and back left extension are approximately 35 inches long. Back right connector 27 and back left connector 29 are approximately 5 inches long. When using optional back right extension 66 and back left extension, back left connector 29 and back right connector 27 are removably engaged to back right joint 23 and back left joint 25.

Back 20 may be constructed without back middle support 64 in which case back right three way connector 60 and back left three way connector 61 would be eliminated, back first left support 63 and back second left support 24 would be one piece and back first right support 62, and back second right support 22 would be one piece.

Top 40 has top bar 42 with a right end fixedly engaged to top right elbow 44 and a left end fixedly engaged to top left elbow 46. Top right support 45 is fixedly engaged to the top of back right elbow 26. Top left support 47 (see FIG. 3) is fixedly engaged to the bottom of back left elbow 28. In the preferred embodiment, top 40 is approximately ten (10) inches in height by thirty (30) inches wide. Top 40 is directed toward the user at an approximate fifty (50) degree angle.

Bin right arm 21 is fixedly engaged to the middle opening of back right joint 23 and extends horizontally at approximately a ninety degree angle to back right support 22 and back right connector 27. Bin right joint 35 has a first horizontal opening which is fixedly engaged to the free end of bin right arm 21. Bin right joint 35 has a second horizontal opening at approximately ninety degrees to the first horizontal opening of bin right joint 35. Bin bottom bar 34 has a first end fixedly engaged to the second opening of bin right joint 35. Catcher 100 may be constructed without bin bottom bar 34 in which case bin right joint 35 does not have a second opening. Bin right joint 35 has a third opening which extends outward at an approximate forty five (45) degree angle to the plane of the first opening and second opening of bin right joint 35. Bin right support 36 is fixedly engaged to the third opening of bin right support 35.

Bin left arm 11 is fixedly engaged to the middle opening of back left joint 25 and extends horizontally at approximately a ninety degree angle to back left support 24 and back left connector 29. Bin left joint 33 has a first horizontal opening which is fixedly engaged to the first end of bin left arm 11. Bin left joint 33 has a second horizontal opening at approximately ninety degrees to the first horizontal opening of bin left joint 33. Bin bottom bar 34 has a second end which is fixedly engaged to the second horizontal opening of bin left joint 33. Catcher 100 may be constructed without bin bottom bar 34 in which case bin left joint 33 does not have a second opening. Bin left joint 33 has a third opening which extends outward at an approximate forty five (45) degree angle to the plane of the first opening and second opening of bin left joint 33. Bin left support 38 is fixedly engaged to the third opening of bin left joint 33.

Back screen 52 is attached to the top half of back left joint 25, back first left support 63, back left three-way connector 61, back second left support 24, back back left elbow 28, top left support 47 (see FIG. 3), top left elbow 46, top bar 42, top right elbow 44, top right support 45, back right elbow 26, back first right support 22, back right three-way connector 62, back first right support 62 and the top half of back right joint 23. In the preferred embodiment, back screen 52 is affixed by plastic ties. Washers are employed on back screen 52 to strengthen the points where the ties pass through. Alternatively, back screen 52 may be glued to the portions of catcher 100 to which it is attached.

Right screen 54 is attached to part of back right support 22, half of back right joint 23, bin right arm 21, bin right joint 35, bin right support 36 and half of bin right elbow 39. In the preferred embodiment, right screen 54 is affixed by plastic ties to catcher 100. Washers are employed on right screen 54 to strengthen the points where the ties pass through. Alternatively, right screen 54 may be glued to the portions of catcher 100 to which it is attached.

Left screen 56 is attached to bin left elbow 37, bin left support 38, bin left joint 33, bin left arm 11, half of back left joint 25 and part of back left support 24. In the preferred embodiment, left screen 56 is affixed by plastic ties to catcher 100. Washers are employed on left screen 56 to strengthen the points where the ties pass through. Alternatively, left screen 56 may be glued to the portions of catcher 100 to which it is attached.

Front screen 59 is attached to bin right joint 35, bin right support 36, bin right elbow 39, bin top bar 32, bin left elbow 37, bin left support 38, bin left joint 33 and bin bottom bar 34. In the preferred embodiment, front screen 59 is affixed by plastic ties to catcher 100. Washers are employed on front screen 59 to strengthen the points where the ties pass through. Alternatively, front screen 59 may be glued to the portions of catcher 100 to which it is attached.

Bin bottom screen 58 is attached to bin bottom bar 34, bin right joint 35, bin right arm 21, back screen 52, back left joint 25 and bin left arm 11. In the preferred embodiment, bin bottom screen 58 is affixed by plastic ties. Washers are employed on bin bottom screen 58 to strengthen the points where the ties pass through. Alternatively, bin bottom screen 58 may be glued to the portions of catcher 100 to which it is attached. Catcher 100 may be constructed without bin bottom bar 34.

Back screen 52, bin bottom screen 58 and front screen 59 may be combined in one piece.

Base 10 has base right four way connector 17, base right front arm 18, base front right elbow 13, base front 12, base front left elbow 15, base left front arm 16, base left four way connector 19, base right rear arm 68, base rear right elbow 70, base rear bar 66, base rear left elbow (not shown), base left rear arm 67 and base middle bar 14. Base right rear joint 17 has a first opening for receiving a first end of base right arm 18. Base right four way connector 17 has a second opening for receiving a first end of base middle bar 14. Base right four way connector 17 has a third opening for receiving base right connector 27. Base right four way connector 17 has a fourth opening for receiving base right rear arm 68. Base left four way connector 19 has a first opening for receiving a first end of base left arm 16. Base left four way connector 19 has a second opening for receiving a second end of base middle bar 14. Base left four way connector 19 has a third opening for receiving back left connector 29. Base left four way connector has a fourth opening for receiving base left rear arm 67. In the preferred embodiment, base 10 is approximately fifteen (15) inches by thirty (30) inches. Base 10 may be constructed without base middle bar 14 in which case base right four way connector 17 and base left four way connector 19 would be three way connectors.

Top 40, back 20 and bin 30 are fixedly connected to each other and are fixedly and removably engaged to base 10. Base 10 may be removed for ease of transportation and storage. In the preferred embodiment, Catcher 100 is made from ½ inch Polyvinyl chloride (PVC) tubing and connectors and synthetic screening. Standard insect screen may be used for back screen 52, right screen 54, left screen 56, bottom screen 59 and front screen 59. Parts that are fixedly connected are joined by PVC glue and parts that are removably connected are joined by friction. Persons skilled in the art are aware of other materials that may be used to construct catcher 100 such as aluminum or steel. Catcher 100 may be formed of plastic in which case sections that are joined using PVC elbows and connectors may be molded in one piece.

Figure 2:
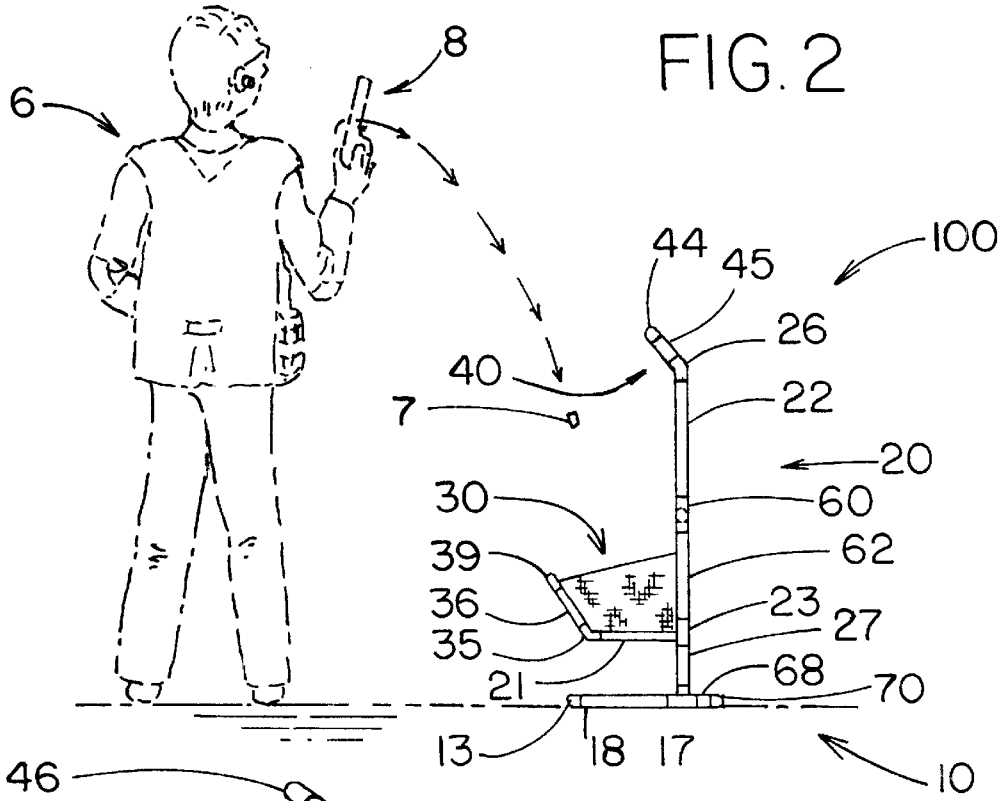
FIG. 2 is a right side view of the invention with shooter and spent cartridge.

In FIG. 2, catcher 100 is shown in use with shooter 6 and spent cartridge 7 ejected from firearm 8 in a trajectory to land in bin 30 of catcher 100. Catcher 100 is positioned on the ground. Catcher 100 may be positioned at varying distances from user 6 depending on the ejection trajectory of the make and model of firearm 8. Bin 30 is large enough to catch ejected cartridges in a variety of trajectories. Back 22 will stop cartridges that would overshoot bin 30 because such cartridges will hit back screen 52 (See FIG. 1) and fall into bin 30. Cartridges that strike top 40 will be deflected downward into bin 30. Without top 40 cartridges striking the top of back 22 may be high enough to bounce off back screen 54 with enough force to miss bin 30. Unlike the prior art devices for catching spent cartridges 7, catcher 100 provides a large open receptacle for the cartridges which gives user 6 some latitude in holding handgun 8 and in the position taken by user 6. The height of bin 30 may be raised by substituting right extension 66 for back right connector 27 and left extension (not shown) for back left connector 29 (not shown).

Figure 3:
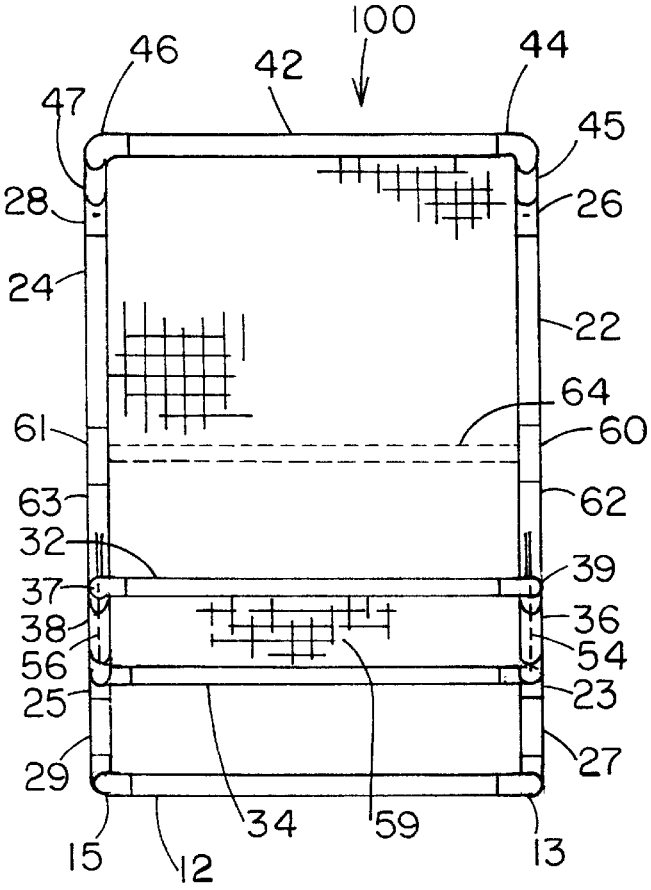
FIG. 3 is a front view of the invention.

FIG. 3 is a front view of catcher 100. In the preferred embodiment, the distance from base bar 12 to bin top bar 32 is approximately 11 inches. Right screen 54 and left screen 38 are affixed to the approximate center lines of bin right support 36 and bin left support 38.

Figure 4:
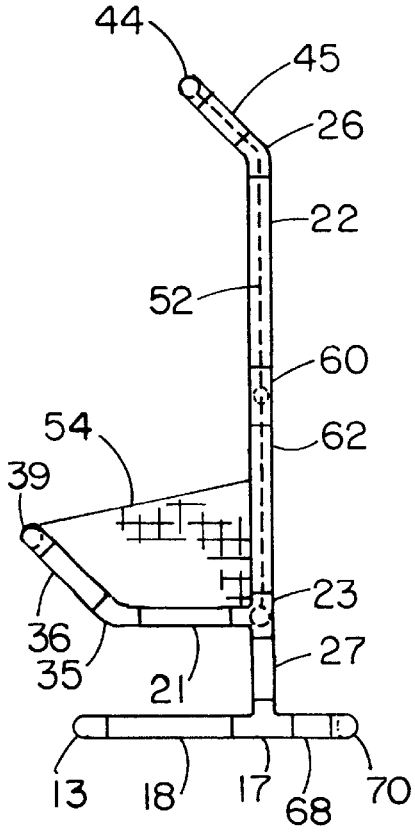
FIG. 4 is a right side view of the invention.

FIG. 4 shows back screen 52 and top screen 45 are affixed to the inside centers of back right support 22 and back left support 24 respectively. Top 40 is angled at an approximate 50 degree angle to back 20. The top of right screen 54 may angle upward to joint back screen 52 (see FIG. 1) and back right support 22 at a point higher than bin top bar 32 (see FIG. 3) to increase the internal area of bin 30.

Figure 5:
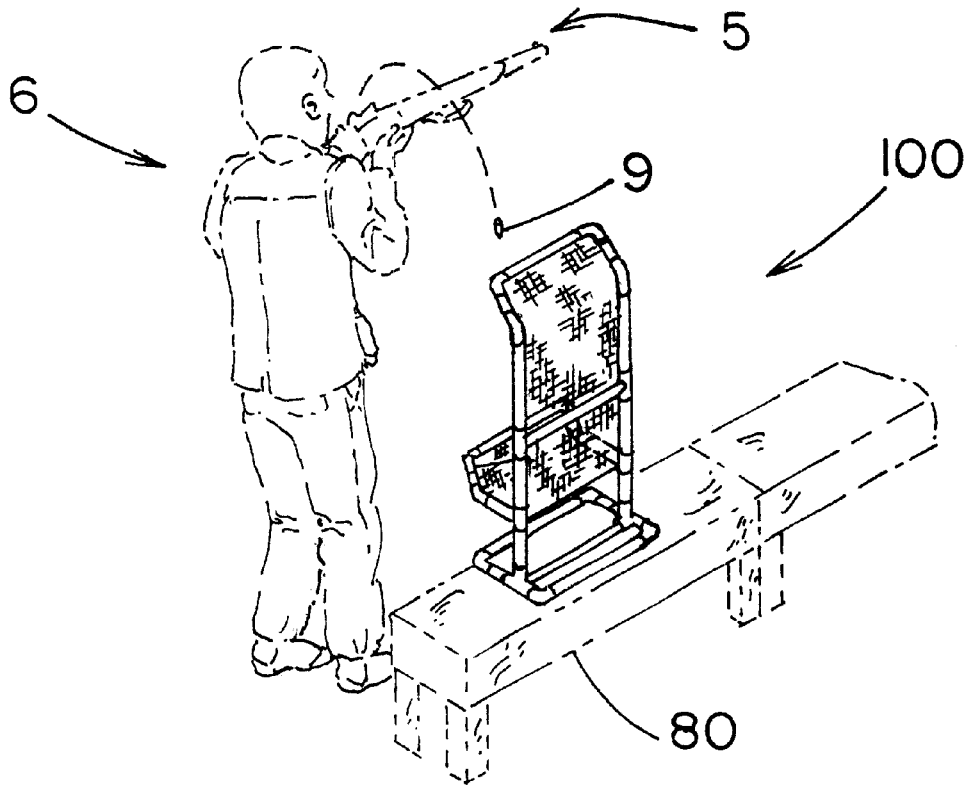
FIG. 5 is a backside view of the invention with shooter and spent cartridge.

FIG. 5 shows shooter 6 with rifle 5 and spent rifle cartridge 9. Catcher 100 is positioned on bench 80.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

I claim:

1. A brass catching apparatus comprising:

a back fixedly engaged to a top;

a bin fixedly engaged to said back;

a base removably affixed to said back; and a base rear bar fixedly engaged to said base.

2. The apparatus of claim 1 further comprising a plurality of screens fixedly connected to said back and said bin.

3. The back of claim 1 further comprising:

a top bar having a top bar right end and a top bar left end a top right elbow fixedly engaged to said to bar right end and a top left elbow fixedly engaged to said top bar left end;

a top right support fixedly engaged to said top right elbow and a top left support fixedly engaged to said top left elbow;

a back right elbow fixedly engaged to said top right support and a back left elbow fixedly engaged to said top left support;

a back right first support having a first end fixedly engaged to said back right elbow and a second end fixedly engaged to a back right three way connector;

a back left support having a first end fixedly engaged to said back left elbow and a second end fixedly engaged to a back left three way connector;

a back right second support having a first end fixedly engaged to said back right three way connector and a second end fixedly engaged to said back right elbow;

a back left second support having a first end fixedly engaged to said back left three way connector and a second end fixedly engaged to said back left elbow;

a back right connector having a first end fixedly engaged to said back right joint and a second end removably engaged to said base; and a back left connector having a first end fixedly engaged to said back left joint a second end removably engaged to said base.

4. The back of claim 1 further comprising:

a top bar having a top bar right end and a top bar left end a top right elbow fixedly engaged to said to bar right end and a top left elbow fixedly engaged to said top bar left end;

a top right support fixedly engaged to said top right elbow and a top left support fixedly engaged to said top left elbow;

a back right elbow fixedly engaged to said top right support and a back left elbow fixedly engaged to said top left support;

a back right support having a first end fixedly engaged to said back right elbow and a second end fixedly engaged to a back two way connector;

a back left support having a first end fixedly engaged to said back left elbow and a second end fixedly engaged to a back two way connector;

a back right connector having a first end fixedly engaged to said back right joint and a second end removably engaged to said base; and a back left connector having a first end fixedly engaged to said back left joint a second end removably engaged to said base.

5. The bin of claim 1 further comprising:

a bin top bar having a bin top bar first end fixedly engaged to a bin right elbow and and a bin top bar second end fixedly engaged to a bin right elbow;

a bin bottom bar;

a bin right support having a bin right support first end fixedly engaged to said bin right elbow and a bin right support second end fixedly engaged to a bin right joint;

a bin left support having a bin left support first end fixedly engaged to said bin left elbow and a bin left support second end fixedly engaged to a bin left joint;

a bin right arm having a bin right arm first end fixedly engaged to said bin right joint and a bin right arm second end fixedly engaged to said back; and a bin left arm having a bin left arm first end fixedly engaged to said bin left joint and a bin left arm second end fixedly engaged to said back.

6. The base of claim 1 further comprising:

a base front bar having a base front bar first end fixedly engaged to base front right elbow and a base front bar second end fixedly engaged to a base front left elbow;

a base left arm having a base left arm first end fixedly engaged to said base left elbow and a base left arm second end fixedly engaged to a base left four way connector;

a base right arm having a base right arm first end fixedly engaged to said base left elbow and a second end fixedly engaged to a base right four way connector;

a base middle bar having a first end fixedly engaged to said base left four way connector and a second end fixedly engaged to said base right four way connector;

a base right rear arm having a first end fixedly engaged to said base right four way connector and a base right rear elbow;

a base left rear arm having a first end fixedly engaged to said base left four way connector and a base left rear elbow;

the base rear bar having a first end fixedly engaged to said base right rear elbow and a second end fixedly engaged to said base left rear elbow; and wherein said base may be removably engaged to said back by removable engagement of said base left joint and said base right joint with said back.

7. The base of claim 1 further comprising:

a base front bar having a base front bar first end fixedly engaged to base front right elbow and a base front bar second end fixedly engaged to a base front left elbow;

a base left arm having a base left arm first end fixedly engaged to said base left elbow and a base left arm second end fixedly engaged to a base left three way connector;

a base right arm having a base right arm first end fixedly engaged to said base left elbow and a second end fixedly engaged to a base right three way connector;

a base right rear arm having a first end fixedly engaged to said base right three way connector and a base right rear elbow;

a base left rear arm having a first end fixedly engaged to said base left three way connector and a base left rear elbow;

a base rear bar having a first end fixedly engaged to said base right rear elbow and a second end fixedly engaged to said base left rear elbow; and wherein said base may be removably engaged to said back by removable engagement of said base left joint and said base right joint with said back.

8. The apparatus of claim 1 further comprising:

a back screen fixedly engaged to said back left joint, said back left support, said back left elbow, said top left support, said top left elbow, said top bar, said top right elbow, said top right support, said back right elbow, said back right support and said back right joint;

a right screen fixedly connected to said back right support, said back right joint, said bin right arm, said bin right joint, said bin right support and said bin right elbow;

a left screen fixedly engaged to said bin left elbow, said bin left support, said bin left joint, said bin left arm, said back left joint and said back left support;

a front screen fixedly engaged to said bin right joint, said bin right support, said bin right elbow, said bin top bar, said bin left elbow, said bin left support, said bin left joint and said bin bottom bar; and a bottom screen fixedly engaged to said bin bottom bar, said bin right joint, said bin right arm, said back screen, said back left joint and said bin left arm.

9. The apparatus of claim 1 wherein said back, said bin and said base are made from polyvinyl chloride.

10. The apparatus of claim 1 wherein said back, said bin and said base are made from steel, aluminum or plastic.

11. The apparatus of claim 1 where said screen is insect screen.

12. An apparatus for catching expended firearm cartridges comprising:

a back fixedly engaged to a top;

a bin fixedly engaged to said back;

a base removably affixed to said back;

a back screen fixedly connected to said back;

a right screen fixedly connected to said back and to said bin;

a left screen fixedly connected to said back and to said bin;

a front screen fixedly connected to said back and to said bin;

a bottom screen fixedly connected to said back and to said bin; and wherein the bin is separated from the base by a back right connector and a back left connector.

13. The apparatus of claim 12 wherein said back, said bin and said base are made from polyvinyl chloride.

14. The apparatus of claim 12 wherein said back, said bin and said base are made from steel, aluminum or plastic.

15. The apparatus of claim 12 where said screen is insect screen.

16. An apparatus for catching expended firearm cartridges comprising:

a back comprising;

a top bar having a top bar right end and a top bar left end;

a top right elbow fixedly engaged to said to bar right end and a top left elbow fixedly engaged to said top bar left end;

a top right support fixedly engaged to said top right elbow and a top left support fixedly engaged to said top left elbow;

a back right elbow fixedly engaged to said top right support and a back left elbow fixedly engaged to said top left support;

a back right support having a first end fixedly engaged to said back right elbow and a second end fixedly engaged to a back two way connector;

a back left support having a first end fixedly engaged to said back left elbow and a second end fixedly engaged to a back two way connector;

a back right connector having a first end fixedly engaged to said back right joint and a second end removably engaged to said base;

a back left connector having a first end fixedly engaged to said back left joint a second end removably engaged to said base;

a bin comprising:

a bin top bar having a bin top bar first end fixedly engaged to a bin right elbow and a bin top bar second end fixedly engaged to a bin right elbow;

a bin bottom bar;

a bin right support having a bin right support first end fixedly engaged to said bin right elbow and a bin right support second end fixedly engaged to a bin right joint;

a bin left support having a bin left support first end fixedly engaged to said bin left elbow and a bin left support second end fixedly engaged to a bin left joint;

a bin right arm having a bin right arm first end fixedly engaged to said bin right joint and a bin right arm second end fixedly engaged to said back;

a bin left arm having a bin left arm first end fixedly engaged to said bin left joint and a bin left arm second end fixedly engaged to said back;

a base comprising:

a base front bar having a base front bar first end fixedly engaged to base front right elbow and a base front bar second end fixedly engaged to a base front left elbow;

a base left arm having a base left arm first end fixedly engaged to said base left elbow and a base left arm second end fixedly engaged to a base left three way connector;

a base right arm having a base right arm first end fixedly engaged to said base left elbow and a second end fixedly engaged to a base right three way connector;

a base right rear arm having a first end fixedly engaged to said base right three way connector and a base right rear elbow;

a base left rear arm having a first end fixedly engaged to said base left three way connector and a base left rear elbow;

a base rear bar having a first end fixedly engaged to said base right rear elbow and a second end fixedly engaged to said base left rear elbow;

a back screen fixedly engaged to said back left joint, said back left support, said back left elbow, said top left support, said top left elbow, said top bar, said top right elbow, said top right support, said back right elbow, said back right support and said back right joint;

a right screen fixedly connected to said back right support, said back right joint, said bin right arm, said bin right joint, said bin right support and said bin right elbow;

a left screen fixedly engaged to said bin left elbow, said bin left support, said bin left joint, said bin left arm, said back left joint and said back left support;

a front screen fixedly engaged to said bin right joint, said bin right support, said bin right elbow, said bin top bar, said bin left elbow, said bin left support, said bin left joint and said bin bottom bar;

a bottom screen fixedly engaged to said bin bottom bar, said bin right joint, said bin right arm, said back screen, said back left joint and said bin left arm; and wherein said base may be removably engaged to said back by removable engagement of said base left joint and said base right joint with said back.

17. The apparatus of claim 16 wherein said back, said bin and said base are made from polyvinyl chloride.

18. The apparatus of claim 16 wherein said back, said bin and said base are made from steel, aluminum or plastic.

19. The apparatus of claim 16 where said screen comprises insect screen.

* * * * *